United States Patent [19]

Nguyen et al.

[11] 4,374,547

[45] Feb. 22, 1983

[54] CRANK CONNECTOR FOR DIRECTIONAL DRILLING

[75] Inventors: Jean-Paul Nguyen, Rueil Malmaison; Emmanuel Laval, Paris; André Cendre, Cosne sur Loire, all of France

[73] Assignee: Institut Francais du Petrole, Rueil-Malmaison, France

[21] Appl. No.: 260,613

[22] Filed: May 5, 1981

Related U.S. Application Data

[63] Continuation-in-part of Ser. No. 60,110, Jul. 24, 1979, Pat. No. 4,286,676.

[30] Foreign Application Priority Data

| | | | |
|---|---|---|---|
| Jul. 24, 1978 | [FR] | France | 78 22063 |
| Apr. 6, 1979 | [FR] | France | 79 08803 |
| Apr. 6, 1979 | [FR] | France | 79 08804 |
| Oct. 13, 1980 | [FR] | France | 80 21890 |

[51] Int. Cl.[3] ..... E21B 7/08

[52] U.S. Cl. ..... 175/45; 175/74

[58] Field of Search ..... 175/61, 73, 74, 75, 175/76, 40, 45, 320; 166/240; 64/1 R, 2 R, 1 S, 11 R

[56] References Cited

U.S. PATENT DOCUMENTS

| | | | |
|---|---|---|---|
| 2,336,333 | 12/1943 | Zublin | 175/75 |
| 3,141,512 | 7/1964 | Gaskell et al. | 175/73 |
| 3,457,999 | 7/1969 | Massey | 175/73 |
| 3,593,810 | 7/1971 | Fields | 175/76 |
| 3,888,319 | 6/1975 | Bourne, Jr. et al. | 175/61 |
| 4,040,495 | 8/1977 | Kellner et al. | 175/61 |
| 4,077,657 | 3/1978 | Trzeciak | 175/74 |

FOREIGN PATENT DOCUMENTS

| | | | |
|---|---|---|---|
| 1494273 | 12/1977 | United Kingdom | 175/61 |
| 652321 | 3/1979 | U.S.S.R. | 175/61 |

*Primary Examiner*—David H. Corbin

*Attorney, Agent, or Firm*—Millen & White

[57] ABSTRACT

An auxiliary locking device for a crank connector of the type including two tubular members interconnected by a shaft having an axis of rotation different from the axes of rotation of the two tubular members. The shaft being rotatably secured to one of the two tubular members, and capable of moving between a first rotatably secured position and a second rotatably disengaged position with respect to the other of said two tubular members for causing the other of the two tubular members to rotate about the axis of rotation of the shaft. The rotation about the axis of the shaft defines acute angles between the axes of rotation of the tubular members and the axis of rotation of the shaft at a point where all three axes intersect. An auxiliary locking means includes at least one retractable finger located in a housing in either one of the shaft and the tubular member disengageable from the shaft, and corresponding grooves located in the other of the shaft and tubular member disengageable from the shaft. The at least one retractable finger extending from its housing when the shaft and corresponding tubular member are disengaged so as to engage the grooves to prevent undesired rotation of the disengaged tubular member after having been rotated about a desired angle, until the shaft and disengaged tubular member reengage thereby forcing the retractable finger to disengage the grooves and retract into its housing.

4 Claims, 23 Drawing Figures

CRANK CONNECTOR FOR DIRECTIONAL DRILLING

CROSS REFERENCE TO RELATED APPLICATIONS

This application is a continuation-in-part application of now allowed co-pending U.S. Application Ser. No. 60,110, filed July 24, 1979, now U.S. Pat. No. 4,286,676.

BACKGROUND OF THE INVENTION

The present invention is directed to a device of the type generally known as a crank connector to be positioned between the lower part of a drill string and a down hole motor rotating a drill bit, the crank connector being of the type which allows adjustment of the orientation of the drill path.

There have been various methods and devices proposed previously for carrying out directional drilling. According to one device described in U.S. Pat. No. 3,365,007, the action of an appropriately directed fluid jet is used for locally destroying ground formations so as to create a recess into which the drill bit will be diverted. An obvious disadvantage of such a device is its lack of accuracy because the jet action of the fluid jet and thus, the resulting bit deflection, will vary substantially depending on the hardness of the geological formations through which drilling is being performed. Another disadvantage is that is becomes necessary to use a specially designed drill bit provided with a nozzle for discharging the fluid jet.

According to another well known method, described for example in British Pat. No. 1,139,908, U.S. Pat. Nos. 3,593,810, 3,888,319, and 4,040,494, and in French Pat. No. 2,297,989, there is used a deflecting device which surrounds a section of the drill string at its lower part, normally in the vicinity of the drill bit. The deflecting device includes a plurality of radially extending fingers which are displaceable with respect to the drill string axis. These fingers are suitably displaced so as to bear on the wall of the drilled bore hole, thereby making it possible to offset the drill bit axis with respect to the bore hole axis and thereby resulting in a deflection of the drilling direction. The use of such devices requires that drilling be discontinuous since the drilling is performed in successive runs between which drilling is stopped to permit the displacement of the deflecting device, and started again in the new direction. This results in a considerable amount of time lost which increases the cost of each drilling operation.

In drilling devices which make use of a down hole motor, it has been proposed to locate the crank connector of selected angle between the lower part of the drill string and the so called drill head (i.e., the assembly of the drill bit and of the down hole motor). However, every time the drilling direction is to be changed, it becomes necessary that the whole drill string be raised to the ground surface to change the crank connector to another one of appropriate angle, the angle being selected in accordance with the desired deflection.

New so-called hinged crank connectors have been described in French Pat. No. 1,252,703, and mentioned in French Pat. No. 2,175,620. These type of connectors usually comprise two tubular parts hinged to each other which can only take two relative positions. In a first position, the two parts of the connector are aligned (the angle of the connector is equal to zero), while in the second position, the two parts are located at a preselected angle with respect to each other. As with the previously described crank connectors, it becomes necessary that at least one element of the connector be raised to the surface when the desired drilling deflection is not compatible with the angle that the two parts of the connector can form with respect to each other.

SUMMARY OF THE INVENTION

Therefore, it is an object of the present invention to provide a crank connector which does not suffer the drawbacks of the above described devices. More particularly, the invention relates to a crank connector consisting of two tubular elements capable of defining between each other an angle which can be varied at will by remote control, the angle varying preferably from a zero value to a predetermined maximum value.

Another object of the present invention, with which this CIP application is particularly concerned, is to provide an auxiliary locking device for rotatably securing the elements of a crank connector together, once the crank connector has been deflected into a desired angle, when the crank connector is in a transition state moving back into the locked drilling state.

To accomplish the angle variations, a tubular element of the connector is pivoted about an axis of rotation which is distinct from the respective axes of the two tubular elements making up the connector, and converges with said axes at one point, the pivoting being achieved by remote control means. In addition, to ensure correct passage into the new angular position, the present invention includes an auxiliary locking device which rotatably locks the two tubular members together once the movement into a desired angle has been accomplished, until the two tubular members are returned to their normal operating position.

BRIEF DESCRIPTION OF THE DRAWINGS

The present invention will be more readily understood, and its advantages made evident from the following description, made with reference to the accompanying drawings. Special reference is made to FIGS. 15A, 15B, and 16 which show the auxiliary locking device with which this CIP application is especially concerned.

DETAILED DISCUSSION OF THE INVENTION

Figure 1:
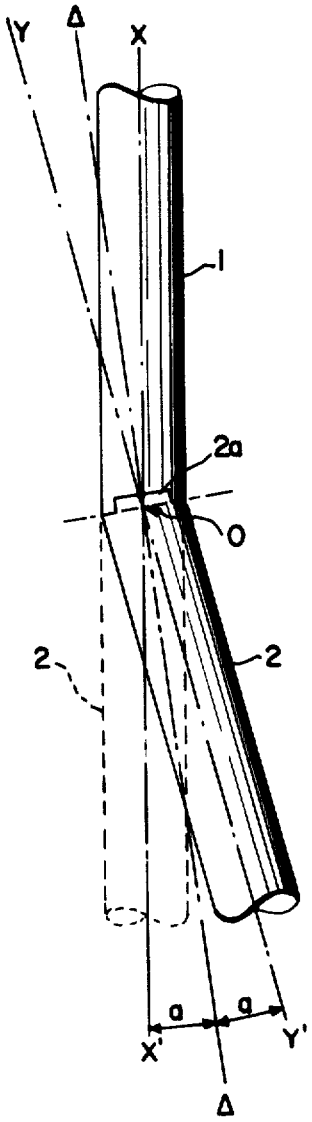
FIG. 1 is a diagrammatic illustration of the crank connector according to the present invention.

FIG. 1 diagrammatically illustrates the basic concept of the crank connector according to the present invention.

The connector includes two tubular members 1 and 2 connected to each other by a fitting element 2A having an axis Δ and fixedly secured, for example to member 2. Tubular member 1 has an axis X'X and tubular member 2 has an axis Y'Y whereby axis Δ converges with axes X'X and Y'Y at one and the same point 0.

The angles (Δ,X'X) and (Δ,Y'Y) formed by the axes are respectively equal to the same value $\alpha$. By continuously rotating element 2 about axis Δ, the angle defined by the axes X'X and Y'Y can be varied between a minimum 0 value (position of member 2 indicated in dotted line of FIG. 1) and a maximum value 2 $\alpha$ (position of member 2 shown in solid line of FIG. 1.

The value of the angle defined by axes X'X and Y'Y is selected to be a function of the maximum value to which it is desired to angle the crank connector of the present invention. The rotation of member 2 about the axis Δ can be performed in a continuous manner and thereby the angle (X'X, Y'Y) can be adjusted to be any desired value between 0 and 2 $\alpha$. However, this rotation can also be performed in steps, two successive positions being separated by a rotation $\theta$ of member 2 about axis Δ, so that $\theta=2\pi/n$, with n being an integer selected so as to obtain n suitable values of the coupling angle, one of the n relative angular positions of members 1 and 2 preferably corresponding to a zero value of the angle (X'X, Y'Y).

The position of alignment of the two tubular members 1 and 2 is used as a reference to define an angle $\phi$ formed by the axes of these two members and defined by the formula:

$$\cos\phi=1-2\sin^2\alpha\sin^2(\theta/2)$$

Figure 2:
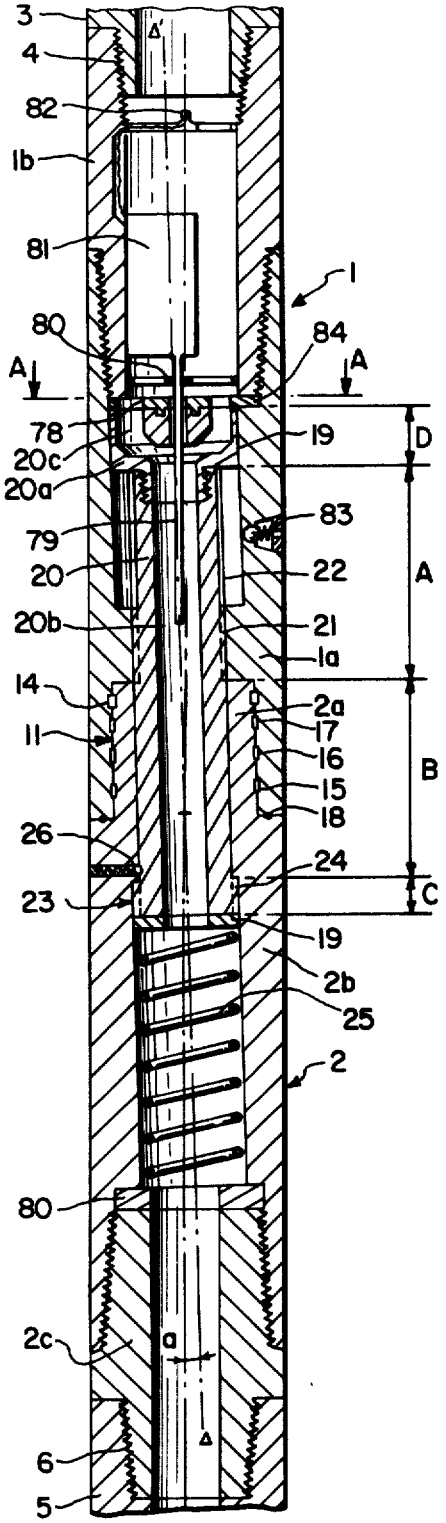
FIG. 2 is an actual cross-section view of a first embodiment of the invention.

FIG. 2 illustrates in cross-section, a first embodiment of the crank connector in a position wherein the axes of the two tubular members are aligned. The tubular member 1 is, for example, made up of plural elements 1A and 1B connected end to end, and is secured to the lower part 3 of the drill string through threads 4.

Member 2 is made up of plural elements 2B and 2C, and is screwed onto a down hole motor 5, such as a turbine, a volumetric or electric motor, through threads 6.

The upper part of member 2 carries a fitting element 2A which is complementary to a bore 11 machined in the lower part of member 1. The fitting element 2A has an axis Δ such that Δ and the respective axes of members 1 and 2 converge at one and the same point 0.

Tubular elements 1 and 2 are held together by bearing 14 capable of withstanding axial stresses applied to the connector when in operation. Element 2A is held centered by roll bearings such as those diagrammatically illustrated at 15, 16 and 17. The roll bearings 15, 16 and 17 permit relative rotation of the tubular members 1 and 2 with respect to each other. Sealing is achieved by a gasket or joint packing 18.

Members 1 and 2 are rotatably secured to each other by a tubular connecting shaft 20 having an axis in line with axis Δ when located in its upper position as shown in FIG. 2. Tubular connecting shaft 20 rotates member 2 about axis Δ by an angle $\theta$ every time the tubular connecting shaft is moved downwardly.

Figure 3:
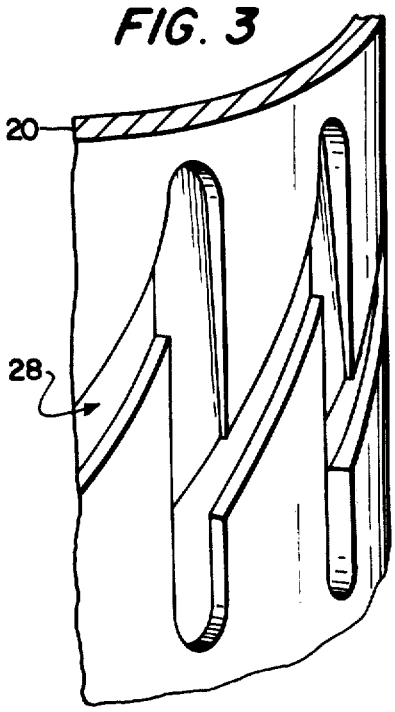
FIG. 3 is a perspective view of a portion of the guide groove producing the camming action in the device of the present invention.

Shaft 20 comprises 4 different functional parts:

1. Part A of shaft 20 includes grooves 22 cooperating with respective complementary grooves 21 which have been machined in the walls of the bore of member 1 so as to rotatably secure member 1 to shaft 20, and at the same time allowing a relative axial displacement of shaft 20 with respect to member 1.
2. Part B includes a profiled guide slot 28 (FIG. 3) cooperating with at least one guide finger 26 carried by member 2. Specifically, the guide slot 28 provides a camming action for varying the angle of the crank connector. Finger 26 is radially retractable into the wall of member 2, against the action of return spring 25 which permanently hold finger 26 in contact with the bottom of groove 28. Groove 28 has a variably tapering depth as shown in FIG. 3. Groove 28 and guide finger 26 cooperate to rotate member 2 as shaft 20 is moved downwardly.
3. Part C includes grooves 23 which include a number n of teeth, or some multiple of n, and the bore of member 2 includes complementary grooves 24. Grooves 23 and 24 rotatably secure members 1 and 2 to each other when shaft 20 is in the upper position.
4. Part D of shaft 20 serves to house a remotely controlled device which provides for the actual displacement of shaft 20 relative to member 1. The remotely controlled device is operative, for example, to close a passage for the drilling fluid flowing through the bore of shaft 20. Gaskets or ring seals 19 serve to seal the inner mechanism from the fluid flow through the connector.

Shaft 20 includes a piston-shaped head 20A, and an inner bore 20B, which ensures the fluid flow, subdivided into a plurality of peripherally extending channels 20C. A disc or circular plate 78 is rotatably mounted on piston 20A and includes passages corresponding to channels 20C. The disc or circular plate 78 can be rotated through a selected angle, relative to piston 28, to partly or completely close the openings of channel 20C through which the drilling fluid flows. Such a rotation can be caused through movement of a control rod 79 having a flat cross-section at the level of disc 78 and extending through a slot in said disc. Control rod 79 is guided by a bearing 80 and is rotated by a rotary electromagnet 81, or by any other electromechanical means. An electrical connection to the ground surface is ensured through an axially located plug 82.

A valve 82 is calibrated so as to permit a sufficient thrust to be exerted on piston 20A, as will be explained hereinafter.

Annular abuttment 84 limits the axially upward displacement of shaft 20 under the action of spring 25 which bears on ring 85. The return spring 25 drives shaft 20 upwardly once the desired rotation $\theta$ has been achieved. As previously described, this particular embodiment operates step wise as indicated below, each step corresponding to a rotation of $\theta=(2\pi/n)$ of member 2 about axis $\Delta$.

After a rotation of n steps, corresponding to a complete revolution of member 2, this member will again be located at its initial position.

Figure 4:
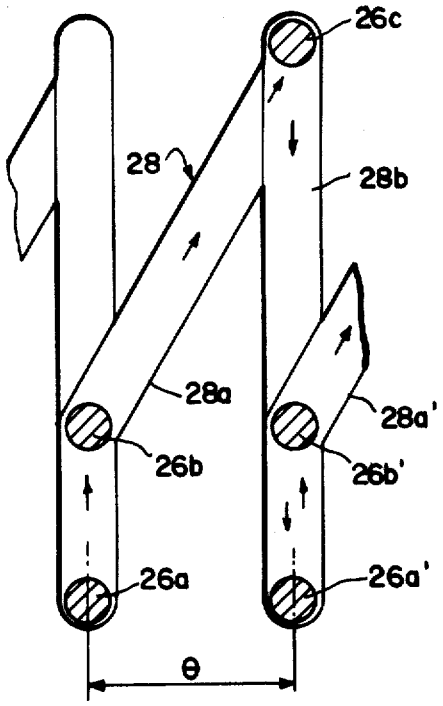
FIG. 4 is a developed view of the guide groove of FIG. 3.

The operation of the described device is as follows:

1. When the bore hole reaches a depth at which the angle of the crank connector must be modified, circulation of the drilling fluid is discontinued and the drill bit is lifted from the bore hole bottom;
2. At this point, the electromagnetic-mechanism 81 is energized to rotate disc 78, thereby closing off the fluid passages in the piston-shaped head 20A of shaft 20;
3. The circulation of drilling fluid is restarted;
4. Piston 20A, which is then subjected to the pressure of the drilling fluid, displaces shaft 20 axially downward as shown in FIG. 2. The position of guide finger 26, relative to groove 28, changes as the finger 26 passes from position 26A to position 26B (FIG. 4). In this position, grooves 23 and 24 are disengaged from each other, and members 1 and 2 are no longer rotatably secured with respect to each other;
5. As shaft 20 continues its axial displacement, the member 2 rotates as a result of finger 26 following the inclined portion 28A of groove 28 until it reaches position 26C, the rotation equal to $\theta$. Piston 20A exposes gauged valve 83, which limits the pressure of drilling fluid above the piston, thus warning the operator on the ground surface that the shaft 20A has traveled the entire stroke. Disc 78 remains in the closed position as a result of control rod 79 being sufficiently long to extend the entire length of travel of the shaft 20;
6. At this point fluid circulation is again shut off;
7. Electromagnetic-mechanism 81 is de-energized and the rod 79 is urged back into its initial position by appropriate mechanical return means (not shown), thereby rotating disc 78 to uncover channels 20C;
8. The return spring 25 urges shaft 20 back to its initial position. Finger 26, which follows the groove portion 28B parallel to the axis of shaft 20, first reaches portion 26B' (FIG. 4); and
9. In the last part of the axial movement of shaft 20, where finger 26 passes from position 26B' to position 26A', grooves 23 of shaft 20 reengage grooves 24 of member 2 to again rotatably secure members 1 and 2 to each other.

An additional rotational $\theta$ can be obtained by repeating the above-described cycle. It is important to note that guide finger 26 moves the position 26A' into 26B' successively, and then automatically engages a new groove portion 28A' as a result of the tapering depth difference in the groove 28, as shown in FIG. 3.

Figure 5:
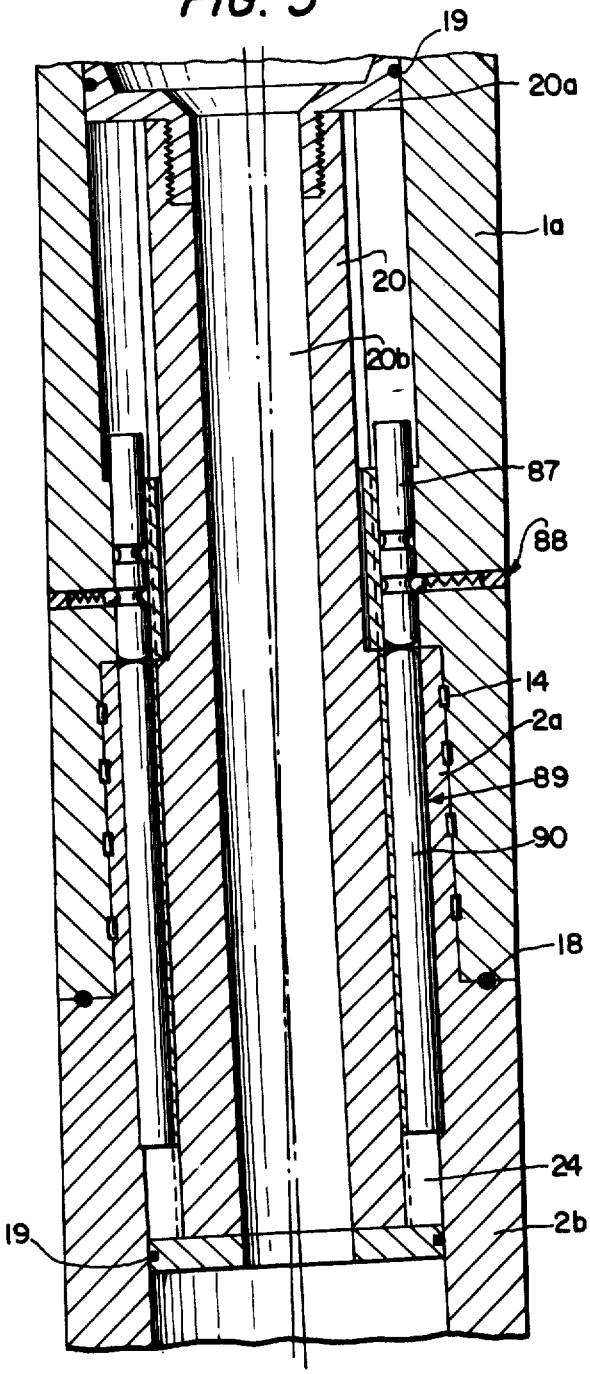
FIG. 5 is a schematic view of one auxiliary locking means for locking the elements of the crank connector against rotation relative to each other.

To ensure the proper sequential movement from position 26C to position 26A', it is possible to use an auxiliary locking device which rotatably secures members 1 and 2 with respect to each other when shaft 20 is displaced under the action of spring 25, which disengages the members 1 and 2 as soon as grooves 23 engage grooves 24. This can be achieved for example, as shown in FIG. 5, by means of at least one locking stud 87 carried by member 1 and held in position by locking ball means 88. A bore 89 coaxial with stud 87, is machined through member 2. The bore 89 has substantially the same diameter as stud 87. Furthermore, bore 89 is positioned so as to open into the space between two consecutive grooves 24 of member 2. There is a return rod 90, having substantially the same length as bore 89, housed within the bore 89.

Figure 6:
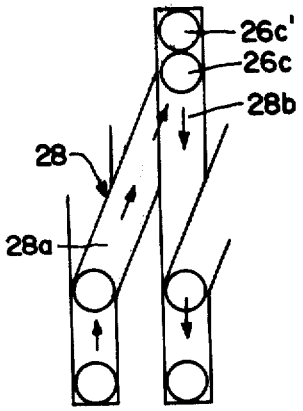
FIG. 6 is a developed view, as in FIG. 4, illustrating the operation of the auxiliary locking means of FIG. 5.

At the end of a rotation of member 2, an additional axial displacement of shaft 20 causes finger 26 to move from position 26C to position 26C' (FIG. 6). During this time, piston 20A bears on stud 87 and forces the latter partly into bore 89, the end of rod 90 being displaced between the two grooves 24 of member 2. Stud 87, locked into said position by locking device 88, rotatably secures members 1 and 2 to each other. As shaft 20 is urged back into its upper "original" position, finger 26 is forced to follow part 28B of groove 28 (FIG. 6). As grooves 23 and 24 again interlock, rod 90 is forced back and stud 87 returns to its initial position.

Figure 7A:
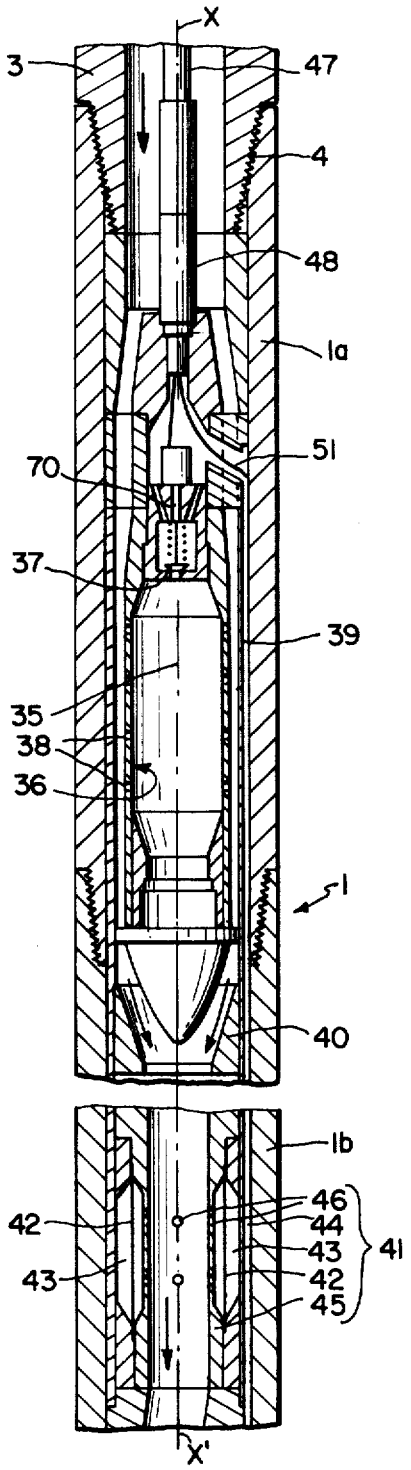
FIGS. 7A and 7B illustrate a second embodiment of the crank connector of the present invention.
Figure 7B:
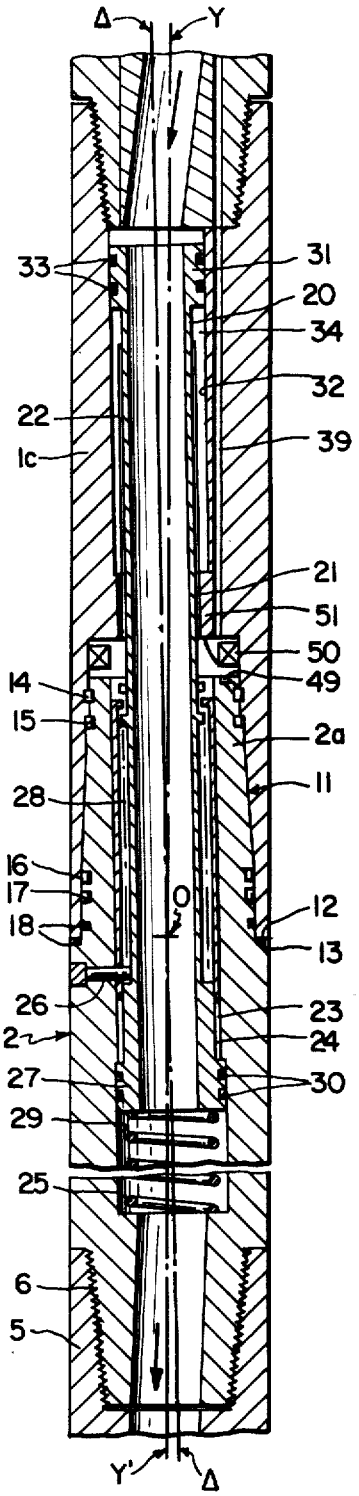

FIGS. 7A and 7B, illustrate, in cross-section, another embodiment of the crank connector of the present invention. The connector shown in FIGS. 7A and 7B differs from the above-described embodiment by the remotely controlled mechanism for displacing shaft 20 and the locking means described in connection therewith.

In the embodiment of FIGS. 7A and 7B, the lower end of shaft 20 is extended by means of a hollow piston 27 which is slidable against the action of spring 25 in the bore 29 of element 2. The axis of bore 29 is aligned with axis $\Delta$. Gaskets or seals 30 ensure sealing between the piston 27 and bore 29.

The upper end of shaft 20 is extended into a hollow piston 31 which is axially slidable in the bore 32 of element 1, the axis of bore 32 being in alignment with the axis $\Delta$. Gaskets or seals 33 ensure sealing between the piston 31 and bore 32. The outer diameter of the lower piston 27 is greater than that of the upper piston 31. In this regard, bores 29 and 32, and pistons 27 and 31, of shaft 20 define between each other a sealed annular space 34.

A tank 35, containing a hydraulic fluid such as oil, is housed in the upper part of the bore of element 1. A tank 35 includes a wall 36 having at least one deformable wall portion which is for example, made of neoprene. The tank 35 is disposed within a rigid protecting housing 37 having a wall provided with apertures 38 for allowing the drilling fluid flowing through the crank connector to exert its pressure on the deformable portion of wall 36 of tank 35. The tank 35 can be placed in communication with space 34 through a duct 39 extending through member 1 and regulated by a valve 70 which is switchable between an open and closed position. The position of the valve 70 which is for example, electrically operated, is remotely controlled from the surface as described below. An area restricting element 40 is placed above piston 27 to create a pressure drop in the flow of drilling fluid. More particularly, element 40 will be located at a level intermediate between space 34 and tank 35. In the illustrated embodiment, element 40 is located in the bore of member 1. However, it would also be possible without departing from the scope of the invention to place the element 40 in the bore of the hollow shaft 20.

Compensating means 41 allows for fluid pressure to be maintained, within the confined space, at substantially the same value as the pressure within the bore of member 2 when the valve is closed and, additionally, compensates for hydraulic leakage. The compensating means 41 comprises a flexible membrane 42 which defines with the bore of member 1, an annular space 43 in communication with duct 39 through apertures 44. The membrane 42 defines with the body 45 of compensator 41, a space communicating with the inner part of the crank connector through apertures 46, downstream of element 40, when considered with reference to the direction of flow of the drilling fluid. The signals for controlling the valve 70 are transmitted from the surface through a cable or line 47 which can be housed in the bore of the drill string 3 at the lower part thereof, or embedded in the wall of the drill string itself. An electric connector 48, which can be of a known type, provides for the electrical connection between cable 47 and the electrically actuated valve 70. Detecting means for detecting the relative position of the two members 1 and 2 of the crank connector can also be provided.

Such detecting means will, for example, comprise a magnetic element such as a permanent magnet 49 secured at the end 2A of tubular member 2, and a set of switches 50 secured to member 1. The switches can be for example, of the type having a flexible blade such as those sold by Radiotechnique under the reference designation "R 122". With reference to each position of member 2, magnet 49 will energize only one switch 50. Detection of the particular switch energized gives the relative angular position of members 1 and 2. To accomplish this detection, the switches can be connected to the ground surface through electrical conductors 51, electrical connector 48 and cable 47. The operation of this embodiment of the crank connector will be described hereinafter with reference to the drawings and assuming that members 1 and 2 are in an initially axially aligned position. The connector is in the position as shown in FIGS. 7A and 7B and the electrically actuated valve 70 is closed.

To accomplish a change in angle, the drilling fluid flows in the direction indicated by the arrows to feed down hole motor 5 such as, for example, a turbine, and for flushing the drill bit which is not shown. The pressure $P_1$ of the hydraulic fluid in the tank 35 is equal to the pressure of the drilling fluid fed through the crank connector. Element 40 creates a pressure drop $\Delta P$ in the flow of drilling fluid so that the value $P_2$ of the pressure downstream of element 40 is lower than $P_1$ and defined by the equation $P_2 = P_1 - \Delta P$.

The compensator 41 serves to maintain the pressure of the hydraulic fluid in the above-defined annular space 34 at a value substantially equal to $P_2$. The gauge spring 25 maintains shaft 20 in the upper position as shown in FIG. 7B and the guide finger 26 is in the position 26A shown in FIG. 4.

To change the angle of the crank connector, a control signal is transmitted from the surface through cable 47, while at the same time the flow rate of drilling fluid is maintained. The control signal causes the opening of valve 70 which places tank 35 in communication with the annular space 34 through duct 39. The hydraulic fluid in space 34, which is at the pressure $P_1$, acts on the lower piston 27 and displaces the latter against the action of spring 25 as a result of the annular space 34 being fed with pressurized fluid from the tank 35. The guide finger is moved into position 26B (FIG. 4), and groove 23 of shaft 20 and groove 24 of member 2, are disengaged from each other. The lower piston 27 is thus further displaced, and the guide finger 26 passes from position 26B to position 26C while member 2 is rotated about axis $\Delta$ by an angle of $\theta = (2\pi/n)$.

When finger 26 reaches position 26C, a control device, comprising for instance an electrical contact (not shown) transmits this information to the surface. The detection means can optionally include the control means.

The flow of drilling fluid is interrupted and the pressure of the hydraulic fluid in tank 35 and annular space 34 becomes substantially equal to the pressure of the drilling fluid in tubular member 7. The gauged spring 25 forces the shaft 20 upwardly (FIG. 7B), thereby forcing the hydraulic fluid back into the tank 35. As a result, finger 26 first reaches position 26B', and then position 26A' wherein member 2 and shaft 20 are again rotatably secured to each other. Valve 70 is then closed. The operation can then be repeated until the angle of the crank shaft is set at the desired value. With valve 70 closed, the drilling operation can be restarted by restoring the flow of drilling fluid.

Figure 8:
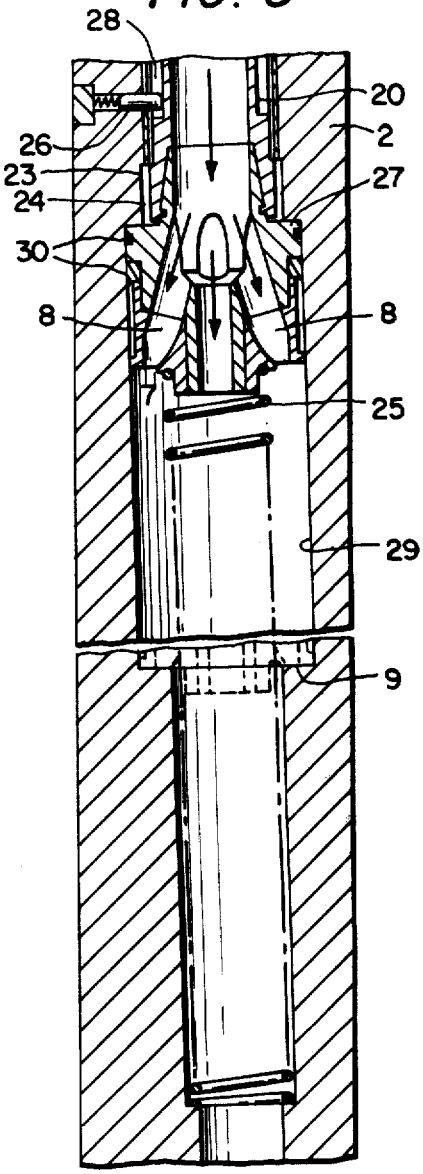
FIG. 8 illustrates an embodiment of the detecting means for detecting the displacement of the connecting shaft.

FIG. 8 shows another embodiment of the means for indicating when finger 26 has reached position 26C.

In the embodiment of FIG. 8, the lower piston 27 allows communication between the bore of shaft 20 and shaft 29 of member 2 through an axially extending duct 7 and a single one, or a plurality of laterally extending ducts 8. In addition, the bore includes an annularly extending shoulder 9 which serves to close off the laterally extending ducts 8 when the piston 27 is in its lower position, as shown in the dashed line in FIG. 8. Thus, when the piston 27 reaches shoulder 9, there results a variation in the flow conditions of the drilling fluid such that said variation can be sensed from the surface.

Figure 9:
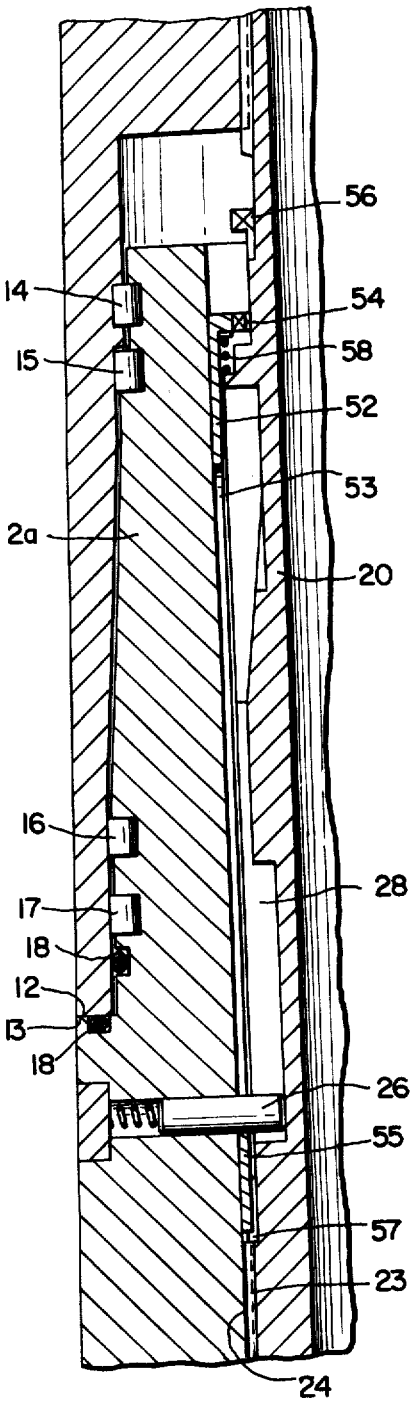

Another embodiment of the means for interlocking members 1 and 2, when piston 20 is located in the lower position, is illustrated in FIGS. 9 through 11E. The locking means in this instance comprises a ring or sleeve 52 which covers the guiding slot 28 (FIG. 9). Ring or sleeve 52 includes at least one groove 53 for receiving the guide finger 26. Groove 53 is shown in a developed view in FIG. 10. At each end, sleeve 52 includes teeth 54 and 55 which are adapted to engage teeth 56 and 57 of shaft 20. A spring 58 located between shaft 20 and sleeve 52 urges the latter in a direction such that teeth 54 and 56 engage each other.

The operation of this embodiment is illustrated in FIGS. 11A through 11E. In these drawings, groove 53 has been shown in hashed lines to facilitate the understanding of the drawing.

Figure 11A:
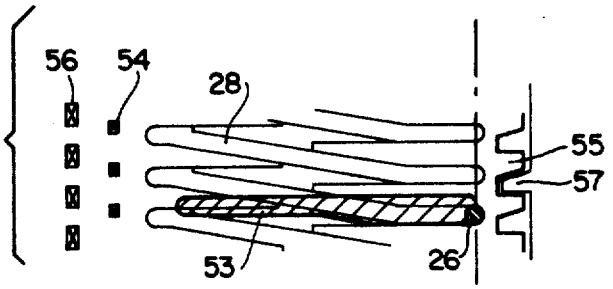
FIGS. 11A through 11E illustrate the operation of the locking ring of FIGS. 9 and 10.
Figure 11B:
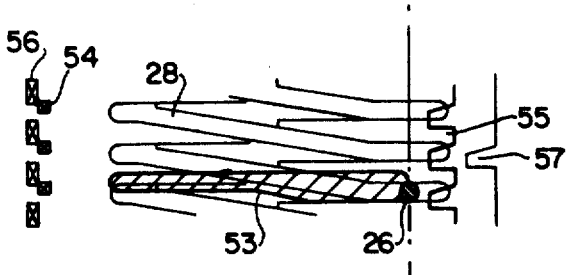
Figure 11C:
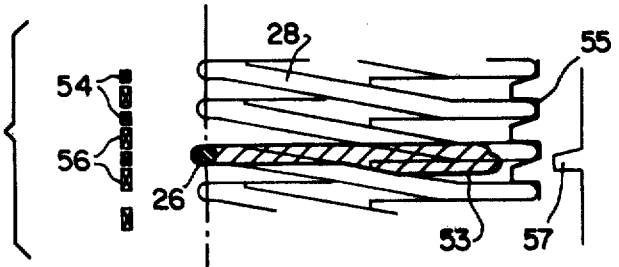
Figure 11D:
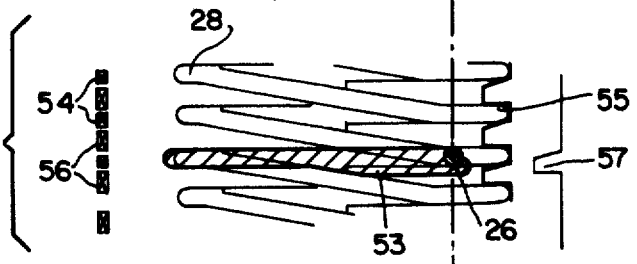
Figure 11E:
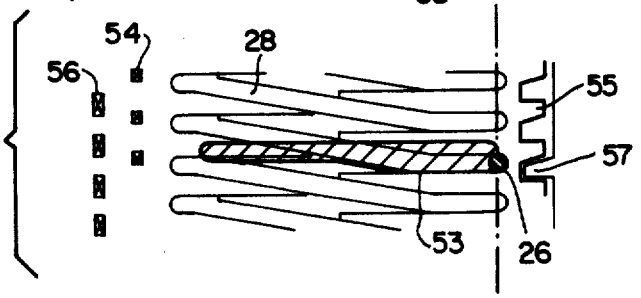

During drilling operations, sleeve 42 is located in the position as shown in FIG. 11A, teeth 55 and 57 being engaged to rotatably secure sleeve 52 to shaft 20. As the shaft 20 is axially displaced, the positions of grooves 28 and 53 with respect to each other are successively as shown in FIGS. 11B through 11E. More particularly, FIG. 11B shows teeth 55 and 57 disengaged, FIG. 11C shows teeth 54 and 56 engaged to rotatably secure sleeve 52 to the shaft 20. FIG. 11C shows the teeth under the action of spring 58 and after a rotation of the sleeve 52 which is driven by guide finger 26. Under these conditions, an axial displacement of shaft 20 in the reverse direction is effected without relative rotation with respect to the guide finger 26 (FIG. 11D). Sleeve 52 and shaft 20 are again rotatably secured to each other through teeth 55 and 57 (FIG. 11E).

Figure 12:
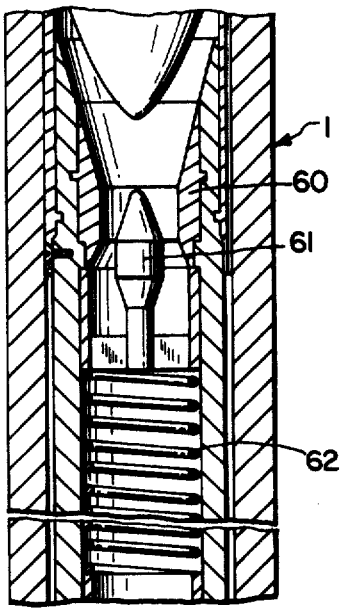
FIG. 12 shows a means for creating a predetermined pressure drop in the flow of drilling fluid.
Figure 10:
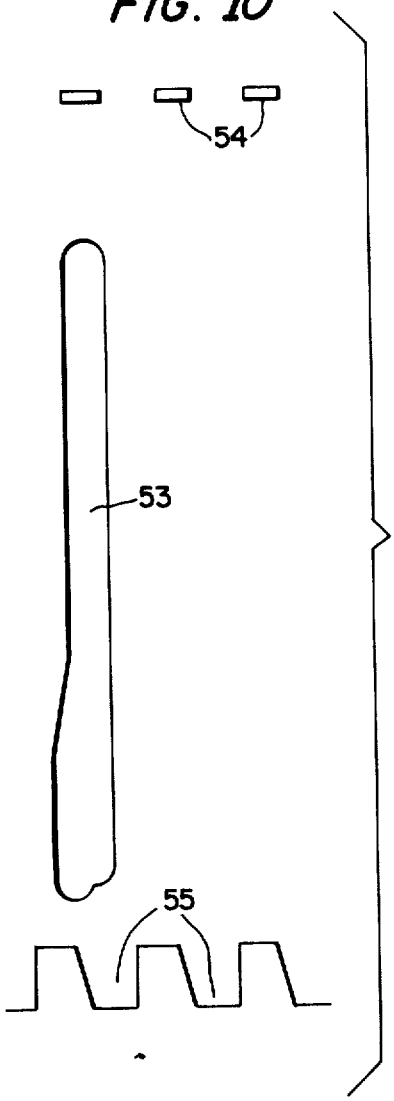
FIGS. 9 and 10 illustrate a locking ring which is part of the auxiliary locking means which cooperates with the guide groove in the present invention.

FIG. 12 shows another embodiment of an element 40 used for creating a pressure drop in the flow of drilling fluid. More particularly, element 40 creates a pressure drop whose value is determined in accordance with the fluid flow rate.

In this embodiment, the element 40 comprises a member 60 which provides a reduction in the diameter of the bore of member 1. A removable element 61 is located in the bore of element 1 and is displaceable therein under the action of the gauged spring 62. As shown in FIG. 12, element 61 is profiled so that the pressure drop in the flow of drilling fluid is substantially independent of the flow rate. To achieve this, the end of element 61 has a generally conical shape. An increase in the flow rate tends to increase the pressure drop and element 1 is then displaced against the action of gauged spring 62 into a new position of equilibrium corresponding to the initial pressure drop for which spring 2 has been calibrated.

Figure 13A:
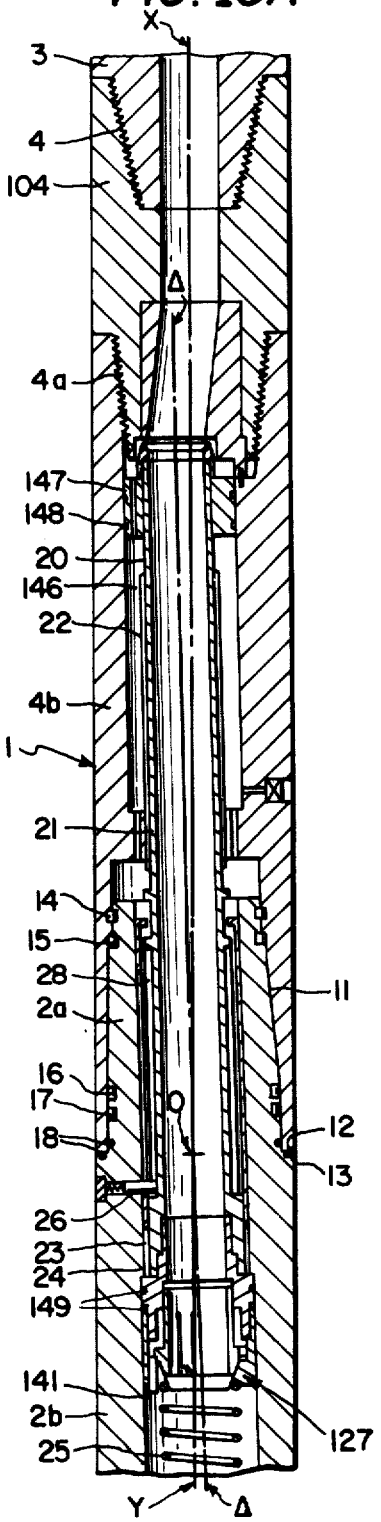
FIGS. 13A and 13B illustrate a third embodiment of the auxiliary locking means of the present invention.
Figure 13B:
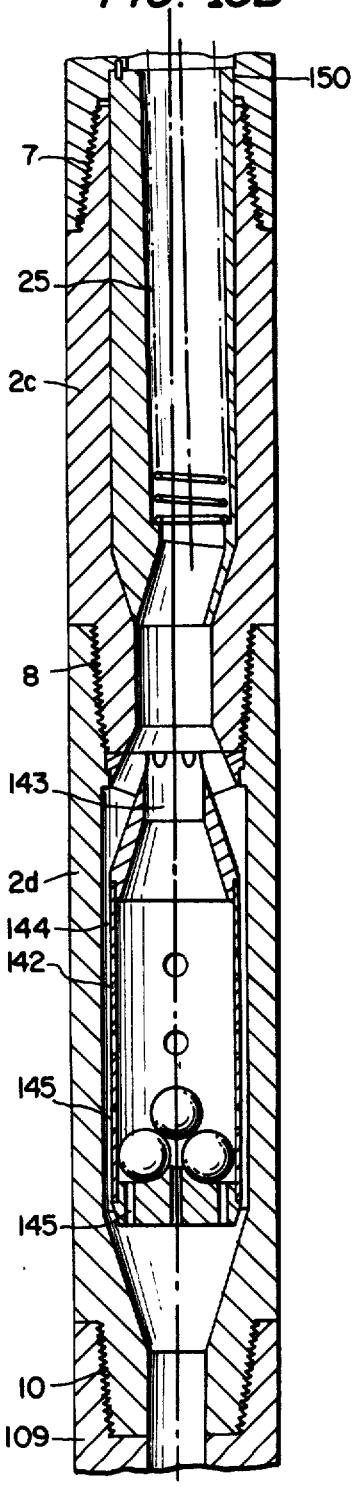
Figure 14:
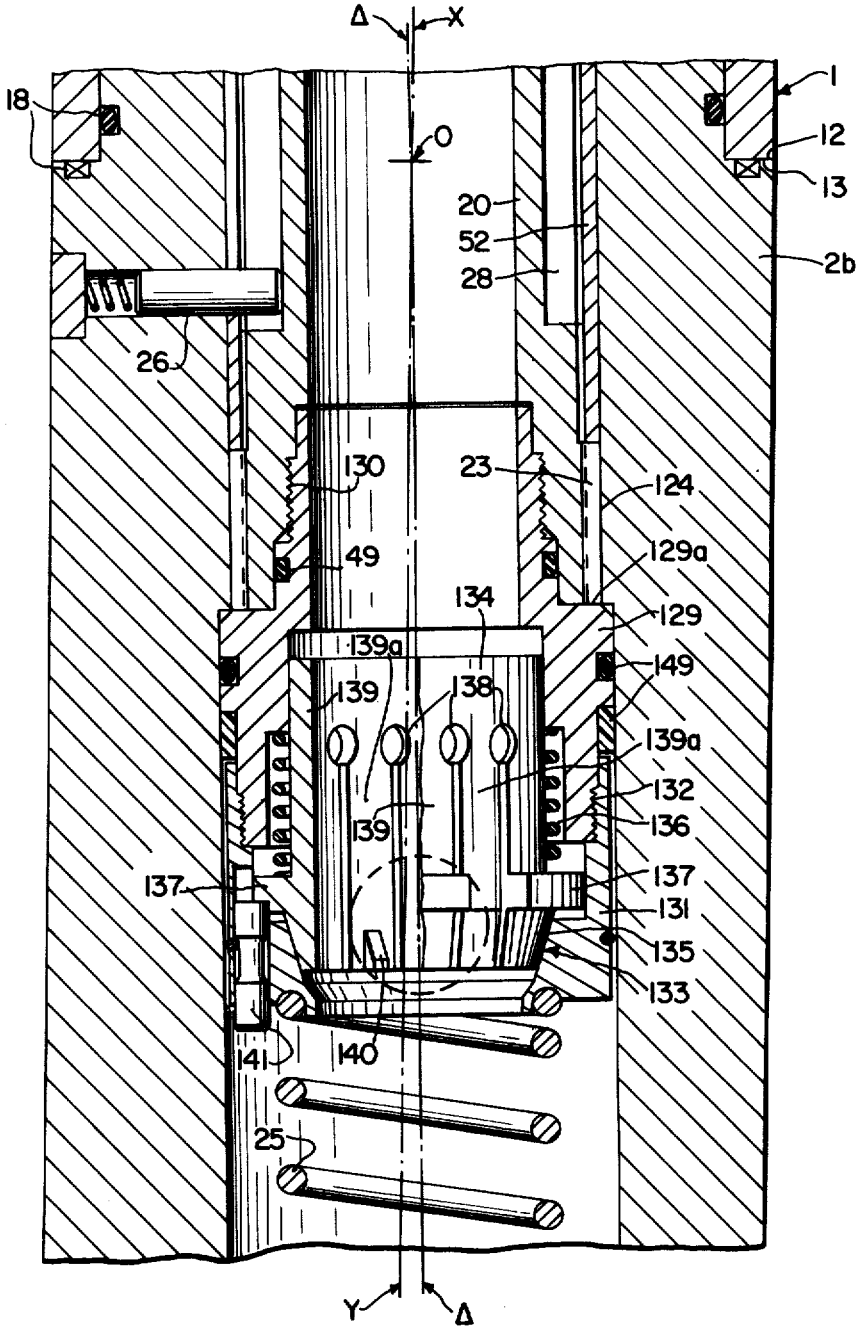
FIG. 14 shows, in an enlarged view, the control mechanism of the embodiment of FIG. 13A.

FIGS. 13A, 13B and 14 show still another embodiment of the crank connector according to the present invention.

The upper member 1 is connected to the lower part 3 of the drill string by an intermediately located connector 104 threaded at 4 and 4A. The lower element 2, which is made up of a plurality of elements 2B, 2C and 2D connected end to end by means of threads 7 and 8, is secured to a downhole motor 109, such as a turbine, through threads 10.

Member 1 includes a bore 11 at the lower end thereof, said bore having an axis Δ. The lower face 12 of member 1 extends in a plane perpendicular to the axis Δ and the plane in which this face is contained passes through the point of convergence of axes X'X and Δ.

The upper end of member 2 carries a fitting portion 2A which is complementary to bore 11 and having an axis defining an angle α with the axis Y'Y of member 2. Member 2 includes a shoulder 13 which is perpendicular to the axis of the fitting portion 2A and is contained in a plane passing through the intersection of axis Y'Y and the axis of fitting portion 2A.

Tubular members 1 and 2 are maintained interlocked by an abuttment 14 capable of withstanding the axial stresses applied to the connector when in operation. The centering of element 2A in bore 11 is ensured by roll bearings such as those diagrammatically shown at 15, 16 and 17 which permit relative rotation of the two tubular members. Gaskets 18 and 19 ensure sealing between the two members 1 and 2.

A hollow shaft 20 is positioned inside tubular members 1 and 2 and coaxial to element 2A and bore 11, i.e., coaxially to axis Δ. Shaft 20 and member 1 are rotatably secured to each other. The securing is obtained by the cooperation of a grooved bore 21 located in the upper member 1, and of complementary grooves 22 located on shaft 20. Shaft 20 also includes grooves 23 which are operative for cooperating with a grooved bore 24 of the lower member 2 when shaft 20 is displaced as a result of the action of spring 25, to the position illustrated in FIG. 13A. In this position, member 2 and shaft 20 are rotatably secured to each other. Shaft 20, which is displaceable within tubular members 1 and 2, includes on its outer wall a profiled guide groove 28 which cooperates with at least one guide finger 26 which is integral with member 2 for rotating member 2 about axis Δ when shaft 20 is axially displaced from its position in FIG. 13A. The profiled guide groove 28, shown in perspective view in FIG. 3, permits step by step rotation of tubular member 2 about axis Δ. The lower end of shaft 20 includes a control mechanism 127 which is shown on a larger scale in FIG. 14. The control mechanism 127 comprises a tubular piston 129 slidable in the bore of the lower member 2, said bore being coaxial to shaft 20. Piston 129 is secured to the end of shaft 20 by threads 130. A valve seat 131 is located in the extension of hollow piston 129 and is connected thereto by threads 132.

Valve seat 131 includes a conically shaped bore 133 for receiving a tubular element 134 having a conically shaped end 135 complementary to bore 133. Element 134 is a clack valve which is axially slidable in a bore of hollow piston 129 and subjected to the action of a spring 136 positioned between piston 129 and an external collar 137 of element 134. The element 134 is split parallel to its axis over a part of its length from its conical end. Split portions 138 define blades 139 of which at least three, which are regularly distributed, are flexible blades 139A having protrusions 140 on their inner wall, with the collar 137 not extending around their outer wall for reasons to be explained below. Valve seat 131 also includes a trigger 141 operative to move element 134 away from valve seat 131 in response to shaft 20 being at a specified position.

At its lower end (FIG. 13B), tubular element 2D includes a basket 142 coaxial therewith. The basket 142 has an opening 143 at its upper end and the sidewalls of the basket define a free annularly extending space 144 for allowing the flow of drilling fluid therethrough. The walls of basket 142 preferably include apertures 145 through which the drilling fluid can also flow.

To provide for efficient lubrication of the shaft 20 and of the different parts of mechanism 127, confined annular space 146, which is defined between the upper element 1 and the shaft 20, includes an oil reservoir therein. The oil reservoir serves another function to be defined in the description of the operation of this embodiment of the invention. The annular space 146 is closed at its upper part by a floating piston 147 which serves to keep the oil pressure at the same value as the pressure of the drilling fluid feeding the crank connector, and enabling compensation for oil leakage by displacement of the piston 147.

Gaskets 148 and 149 ensure sealing at the levels of the floating piston 147 and the control mechanism 127 respectively.

The operation of the device is as follows. Assuming the crank connector is in the position shown in FIGS. 13A and 13B, the axes of tubular members 1 and 2 are aligned and the drilling has reached the depth at which the drill path is to be deflected. At this point, without interrupting the flow of drilling fluid, a steel ball having a selected diameter is introduced into the drill string. The travel of the ball is stopped by protrusion 140 of blades 139A, as shown in the dashed lines in FIG. 14. The ball causes a pressure drop ΔP in the flow of drilling fluid and the pressure prevailing in the bore of shaft 20 is transmitted by the floating piston 147 (FIG. 13A) and the oil to the upper face 129A of the piston 129. The flow of drilling fluid, acting directly on the ball and piston 129 by the pressure difference ΔP, displaces shaft 20 axially in the direction of flow against the opposing action of spring 25. Finger 26 which was initially in position 26A (FIG. 4) reaches position 26B.

In this position, grooves 23 of shaft 20 become disengaged from grooves 24 of the lower member 2 and consequently, the shaft 20 is no longer rotatably secured to the lower member 2. When the shaft 20 is further axially displaced, finger 26 reaches the position 26C and rotates member 2 about axis Δ by an angle $\theta = 2\pi/n$.

As guide finger 26 reaches position 26C, trigger finger 141 comes into contact with shoulder 150 of body member 2 (FIG. 13B). This contact keeps element 134 in position while shaft 20 and valve seat 131 are further displaced to compress spring 136.

The conical part 135 no longer contacts the outer collar 137, and the resilient blades 139A which are no longer retained by collar 137, move apart from the axis of the device so that the released ball falls into basket 142 (FIG. 13B) at the lower part of the coupling. The pressure drop created by the ball is thus discontinued, and piston 129 is no longer subjected to the pressure difference $\Delta P$.

As a result, the calibrated spring 25 urges shaft 25 back upwardly, and spring 136 presses element 134 against valve seat 131. The guide finger 26 passes from the position 26C to position 26B', and then to position 26A' where grooves 23 and 24 again rotatably secure shaft 20 to lower member 2. Shaft 20 is then back in the same position as in FIG. 13A.

The same operating cycle can be repeated by introducing more steel balls into the drill string. The basket 142 can be emptied when the drill string is raised to the surface, for example for changing the drill bit. The capacity of the basket 142 can be as great as desired, for example 10 to 20 balls or more.

The locking device described with reference to FIGS. 9 to 11E, using a ring or sleeve 52 around the guide groove 28 can also be used in this embodiment.

Figure 15A:
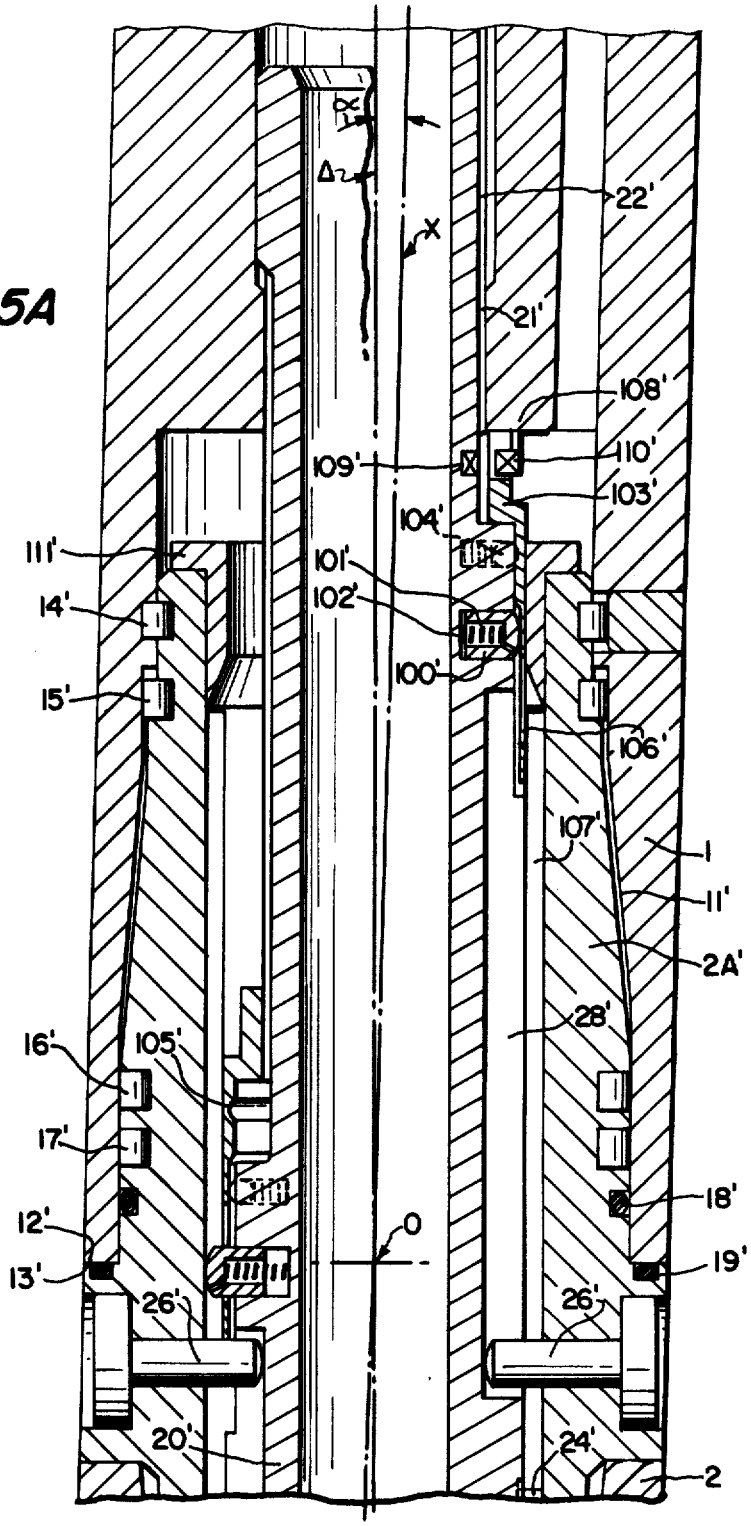
FIGS. 15A and 15B illustrate still another embodiment of an auxiliary means for locking the elements of the crank connector against relative rotation, and the operation thereof.
Figure 15B:
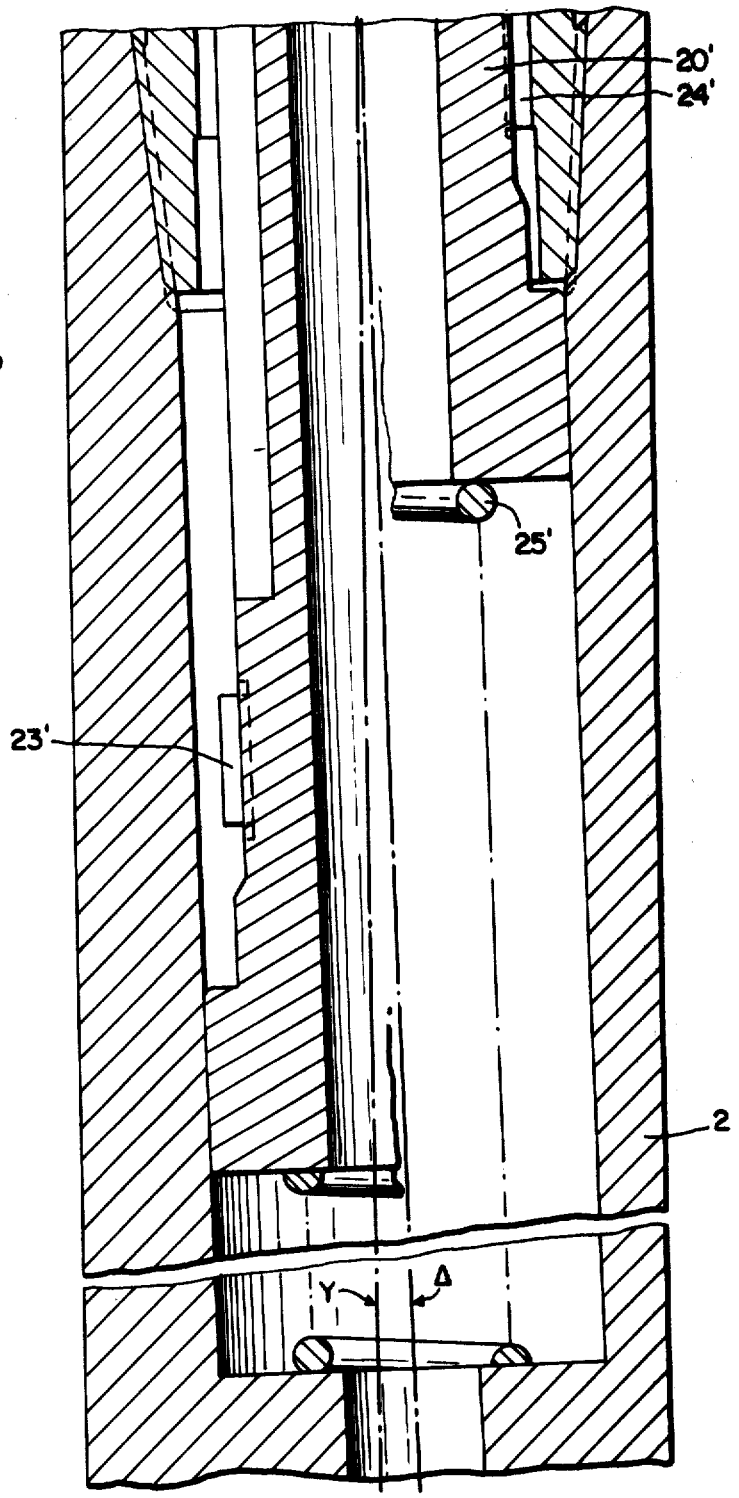
Figure 16:
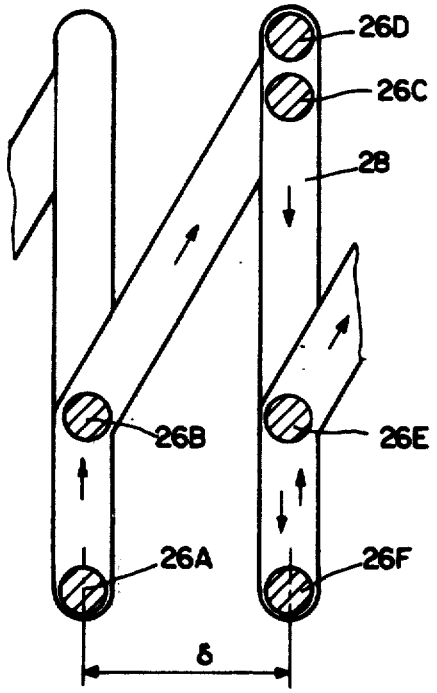
FIG. 16 is a developed view, as in FIGS. 4 and 6, illustrating the operation of the auxiliary locking means of FIGS. 15A and 15B.

Still another embodiment of an auxiliary locking device for use in the crank connector of the present invention is shown in FIGS. 15A and 15B. This embodiment is of special interest in the present CIP application. Reference is also made to FIGS. 3 and 16 describing the operation of this embodiment of the auxiliary locking means.

FIGS. 15A and 15B show schematically the primary elements of the invention. More particularly, tubular members 1 and 2 and shaft 20' are shown in the position wherein the crank connector is at an angle equal to zero. As described previously, tubular member 1 is attached to drill string and tubular member 2 has a motor attached at the bottom thereof.

For the sake of simplicity in describing this embodiment, the tubular members are shown as single piece elements however, it is clear that each member can be made up of a plurality of elements which are assembled to facilitate the use or operation of the invention. In the lower portion of member 1 is machined a bore 11' coaxial with the axis $\Delta$. The bottom surface 12' of member 1 is in a plane perpendicular to the axis $\Delta$ and the plane of said surface intersects the point of intersection of the axes X'X and $\Delta$. The upper end of the member 2 includes an extended portion 2A' which is tapered to correspond to the machined bore 11' and having an axis which defines, with the axis Y'Y of member 2, an angle $\alpha$. Tubular member 2 includes a shoulder 13' whose surface is perpendicular to the axis of the joining extension 2A', said surface located in the plane wherein the axis Y'Y and the axis of a element 2A' intersect. Element 2' fits into the machined bore 11' so as to join tubular members 1 and 2 together.

The tubular members 1 and 2 are held together by a lug 14' capable of withstanding the axial pressures applied on the coupling when drilling is being performed. The centering of element 2A' within the machine bore 11' is accomplished by bearings such as those shown at 15', 16' and 17', and which permit relative rotation of the two tubular members. Seals or gaskets 18' and 19' assure the tight fit between tubular members 1 and 2.

A shaft 20' is disposed on the interior of tubular members 1 and 2 coaxially with element 2A' and bore 11', i.e., coaxially with axis $\Delta$. The shaft 20' and the tubular member 1 are rotatably secured. This is accomplished by grooves 21' which are machined into the tubular member 1 and complementary grooves 22' located on the shaft 20'. Shaft 20' also includes ridges 23' which are capable of engaging a plurality of grooves 24' located on the tubular member 2 such that the shaft 20' is positioned, as a result of the action of spring 25', as shown on the right hand side of FIGS. 15A and 15B. In that position, tubular member 2 and the shaft are rotatably engaged.

Shaft 20', which is axially movable within the interior of the tubular members 1 and 2, includes on its outer surface, a profiled groove 28' which cooperates with at least one guiding finger 26' attached to tubular member 2 for causing said tubular member to turn about the axis when the shaft 20' is axially displaced from the position shown on the right hand side of FIGS. 15A and 15B. The groove 28', shown in perspective in FIG. 3, allows a step by step rotation of the tubular member 2 about the axis.

The lower part of the shaft 20' can include for example, control means (not shown) of the type such as previously described.

The crank connector includes an auxiliary locking device which comprises at least one finger 100' radially contractable against the force of a spring 101'. Finger 100' is located in an opening 102' machined into the shaft 20'. A collar or sleeve 103' slidable on shaft 20' on which it is rotatably secured maintains the finger 100' within its opening when the shaft 20' is rotatably secured to the tubular members 1 and 2, i.e., when the shaft is in the position shown on the right hand side of FIGS. 15A and 15B and during the relative rotation of the tubular members 1 and 2. In that position, the collar 103' is maintained axially on the shaft 20' by means of balls 104' which cooperates with the slots 105' in the collar 103'. Collar 103' also includes orifices 106', the function of which will become more evident in the following description.

Grooves 107' are machined on the interior of tubular member 2 parallel to the axis thereof and corresponding substantially to the profile of groove 28'.

The operation of this embodiment is as follows. Assuming that the crank connector is in the position shown by the right hand side of FIGS. 15A and 15B, the axes of the tubular members are aligned and the drilling has been terminated after having reached the desired depth at which the angle of drilling will be changed.

The shaft 20' is displaced axially as shown on the left hand side of FIGS. 15A and 15B against the action of spring 25'. The finger 26' which is in position 26A (FIG. 4), moves to position 26B. In said position, the grooves 23' of shaft 20', and 24' of tubular member 2, are disengaged one from the other, allowing free rotation of shaft 20' with respect to tubular member 2. The axial movement of the shaft 20' continues and finger 26' reaches position 26C, and causes the rotation of tubular member 2 about the axis $\Delta$ at an angle of $\delta = 2\pi/n$ (n is a whole number). The tubular members 1 and 2 of the crank connector thus move into an angle, between the two, of between 0 and $2\alpha$.

Simultaneously, the end of collar 103' contacts the fingers 26' which prevent an additional displacement of the collar 103'. As the axial displacement of the shaft 20' continues, finger 26' causes the collar 103' to separate from said shaft, allowing the retactable fingers 100' to enter the opening 106' of the collar 103'. As a result of the action of the springs 101', the fingers 100' extend from their lodgings and their ends extend into the grooves 107' and rotatably secure the shaft 20' to the tubular member 2. As shown on the left hand side of FIGS. 15A and 15B, the fingers 26' are now in position 26D (FIG. 6).

As the shaft 20' is subjected to the action of the spring 25', the shaft 20' is forced back axially to the position shown on the right hand side of FIGS. 15A and 15B. As a result of the cooperation of the fingers 100', and the grooves 107', the finger 26' is displaced axially from position 26D directly to position 26E (FIG. 16), specifically, without any relative rotation between the two tubular members 1 and 2.

At this moment, the collar 103' contacts an abuttment 108' of tubular member 1 which immobilizes it axially. The additional movement of the shaft 20' causes the displacement of the fingers 26' from the position 26E to position 26F (FIG. 16) such that fingers 100' are forced back into their lodgings 102' through the inner action with an inclined ramp 111', and the collar 103' is brought back into its original position with respect to shaft 20'. The assembly thus returns to the position illustrated on the right hand side of FIGS. 15A and 15B.

A new rotation $\delta$ of tubular member 2 can be obtained by repeating the above described operation.

Various modifications can be made in this embodiment without departing from the invention. For example, control means can be provided for ensuring that subsequent the displacement, the shaft 20' has returned to its original position. To accomplish this, a magnetic detector 109', permanently attached to the shaft 20', and a deflector such as those commercially available from RADIO TECHNIQUE under the reference "R22" can be provided. The detector can be fixed to the tubular member 1 and can be connected to an electric circuit which is not shown. By detecting the position of the magnetic element 109', the total axial displacement of the shaft 20' can be detected.

In this example, the retractable fingers 100' are located in the shaft 20' and the axial grooves 107' in the tubular member 2. The reverse is also possible. Having described the invention in full detail, the scope thereof will be defined in the claims.

What is claimed is:

1. In a crank connector adapted for having its angle varied by remote control, the crank connector comprising first and second tubular members interconnected by a shaft, the shaft having an axis of rotation different from the axes of rotation of said first and second tubular members and fixedly rotatably secured to one of the first and second tubular members and movable between a locked rotatably secured poisition and a non-locked rotatably disengaged position with respect to the other tubular member, the shaft being movable into the non-lock position for causing said other tubular member to rotate about the axis of rotation of the shaft whereby the axes of rotation of the tubular members and the axis of rotation of the shaft define acute angles, and an auxiliary locking means for preventing relative rotation of the tubular members when disengaged and moved into the desired relative angular position prior to the tubular members being rotatably re-engaged, the improvement wherein the auxiliary locking means comprises at least one retractable locking finger positioned in a housing in one of the shaft and second tubular member, and axially extending grooves in the other of the shaft and second tubular member, said at least one locking finger and grooves located so as to have said at least one locking finger extend from its housing to engage a corresponding one of said grooves after said shaft causes a desired rotation of said second tubular member when rotatably disengaged from said second tubular member, thereby preventing a further rotation of the second tubular member until the shaft and second tubular member return to a rotatably secured position, said at least one finger adapted for being forced back into its housing when said shaft and second tubular member are moved into a rotably secured position.

2. An auxiliary locking means as in claim 1 wherein said axially extending grooves are located on said second tubular member and said at least one retractable finger is located in a housing in said shaft.

3. An auxiliary locking means as in claim 1 wherein said axially extending grooves are located on said shaft and said at least one retractable finger is located in a housing in said second tubular member.

4. An auxiliary locking means as in claim 1 further comprising detecting means for detecting when said shaft has returned to its rotatably secured position with respect to said second tubular member.

* * * * *